United States Patent [19]

Strange et al.

[11] Patent Number: 4,955,818

[45] Date of Patent: Sep. 11, 1990

[54] ELECTRICAL COMPONENT CONNECTOR

[75] Inventors: Andrew H. Strange, Eagleville, Pa.; William P. Sharpe, Newport, R.I.

[73] Assignee: Elastomeric Technologies, Inc., Hatboro, Pa.

[21] Appl. No.: 389,529

[22] Filed: Aug. 4, 1989

[51] Int. Cl.[5] ..... H01R 23/72

[52] U.S. Cl. ..... 439/66; 439/91

[58] Field of Search ..... 439/86, 91, 66, 71, 439/591, 69, 70, 72–74

[56] References Cited

U.S. PATENT DOCUMENTS

| | | | |
|---|---|---|---|
| 4,144,648 | 3/1979 | Grovender | 439/331 |
| 4,533,976 | 8/1985 | Suwa | 439/66 |
| 4,652,973 | 3/1987 | Baker et al. | 439/91 |
| 4,818,238 | 4/1989 | Borg | 439/71 |
| 4,820,170 | 4/1989 | Redmond et al. | 439/91 |

FOREIGN PATENT DOCUMENTS

| | | | |
|---|---|---|---|
| 62570 | 6/1978 | Japan | 439/86 |

*Primary Examiner*—Gary F. Paumen

*Attorney, Agent, or Firm*—Ratner & Prestia

[57] ABSTRACT

There is provided an apparatus for connecting an electrical component, such as a chip carrier to a printed circuit board. The connector is made up of a housing having a recess for receiving the chip carrier. The housing also contains a passage in which strips of elastomeric elements are fitted. When a chip carrier is positioned within the connector, contact is made between the chip carrier and the elastomeric elements at the lateral sides of the chip carrier. The elastomeric element strips also make contact with the printed circuit board to effect electrical connections between the chip carrier and the printed circuit board.

10 Claims, 2 Drawing Sheets

ELECTRICAL COMPONENT CONNECTOR

FIELD OF THE INVENTION

This invention relates to apparatus for making electrical connections between electrical components. In particular, it relates to an assembly for mounting an electrical component, such as a chip carrier, onto a printed circuit board by using elastomeric elements to form the electrical contact between the component and the printed circuit board.

BACKGROUND OF THE INVENTION

Integrated circuits are widely used in the electrical and computer industries. Typically, they are used in conjunction with other electrical components attached to electronic substrates such as printed circuit boards.

The actual integrated circuit is contained in a chip carrier with electrical contacts (leads) on the outside of the chip carrier. Chip carriers which have two parallel sets of leads are referred to as dual-in-line packages (DIPs). The increasing complexity and density of circuitry within an integrated circuit has made it common to find chip carriers having leads extending from all four sides of a substantially square package.

The chip carrier leads can be connected to a printed circuit board either directly or through an intermediary device such as a chip carrier connector or socket. Soldering the chip carrier directly on to a printed circuit board is a common practice, but is not a desirable method for all integrated circuits. Particularly sensitive chips such as processors or memory are susceptible to damage from voltage spikes or excessive heat. Both of these conditions may arise during production soldering. Also, it is often necessary or desirable to have easy replacement or substitution of chips. Once chips are soldered to a printed circuit board, it can be impractical to replace them.

One solution to the above problems is to solder a chip carrier connector or socket onto the printed circuit board and insert the chip carrier into the connector at a later time during production. This solution still has some problems, as it may be necessary to drill numerous holes in the printed circuit board to accommodate the leads of the connector. Drilling increases both the cost and the complexity of printed circuit board design and production. Additionally, in multilayer circuit board, drilling may take up valuable "real estate" on the different layers of the circuit board. Yet another problem with chip carrier connectors or sockets which have spring contacts is that these contacts introduce inductances and capacitances which limit the switching times of the circuitry. Usually, these spring contacts are long to develop the desired springiness for insertion, retention and withdrawal of the chip carrier. Besides adding to the undesirable inductances and capacitances, long spring contacts add to the height or profile of the connector.

Another problem which arises with solder connections involves the differences in the coefficients of thermal expansion between the chip carriers and the electronic substrates. As different parts expand at different rates, rigid connections (i.e. solder connections) may cause one or both of the parts to break. Having identical coefficients of thermal expansion between electrical components is usually a very expensive and complicated engineering and manufacturing endeavor.

Elastomeric elements have been used to address some of the problems in connecting chip carriers to printed circuit boards which are described above. For example, in U.S. Pat. No. 4,652,973, issued Mar. 24, 1987 to Paul A. Baker et al. there is described an apparatus for mounting ceramic chip carrier devices onto printed circuit boards using both metal and elastomeric contact units. In the Baker apparatus, contact is made between the chip carrier and the printed circuit board from the bottom side of the chip carrier. This design requires a cover to maintain contact between the chip carrier and the elastomeric elements. U.S. Pat. No. 4,144,648, issued Mar. 20, 1972 to Steven L. Grovender, et al., describes a connector for mounting a semiconductor package to a printed circuit board. Grovender requires that holes be drilled in the circuit board to mount a frame upon which a cover is attached. The cover is necessary to apply pressure to the chip carrier to maintain contact with the elastomeric elements.

The Baker et al. and Grovender et al. patents are but two examples of chip carrier connectors using elastomeric elements in which contact between the chip carrier and the elastomeric elements is effected in the direction of insertion of the chip carrier into the connector. Besides requiring a lid to clamp the chip carrier in place, which adds cost to the assembly, the lid also adds to the height of the connector. Also, a chip carrier is vulnerable to breakage with pressure applied across its thickness. In addition, a mechanical stop should be provided in the connector recess to prevent canting of the chip carrier rather than using the elastomeric elements for this purpose. This makes the socket height sensitive which the result that accuracy in the formation of the socket is required to assure that proper contact between the chip carrier and the elastomeric elements is established.

SUMMARY OF THE INVENTION

The present invention comprises an electrical component connector which includes a housing having a recess for receiving an electrical component. At least one elongated passage extends through the housing from an opening along a wall of the recess to an external surface of the housing. Fitted within the passage is a strip of elastomeric elements which presents to the contact leads of an electrical component inserted within the recess a contact surface which is perpendicular to the base surface of the recess. The strip of elastomeric elements extends through the passage to an external surface of the housing for making contact with an electronic substrate, such as a printed circuit board.

In one preferred embodiment of the invention, the housing is adapted to receive a chip carrier, while in a second preferred embodiment of the invention, the housing is adapted to receive an edge card.

BRIEF DESCRIPTION OF THE DRAWINGS

In the accompanying drawings which illustrate the invention.

DETAILED DESCRIPTION

Figure 1:
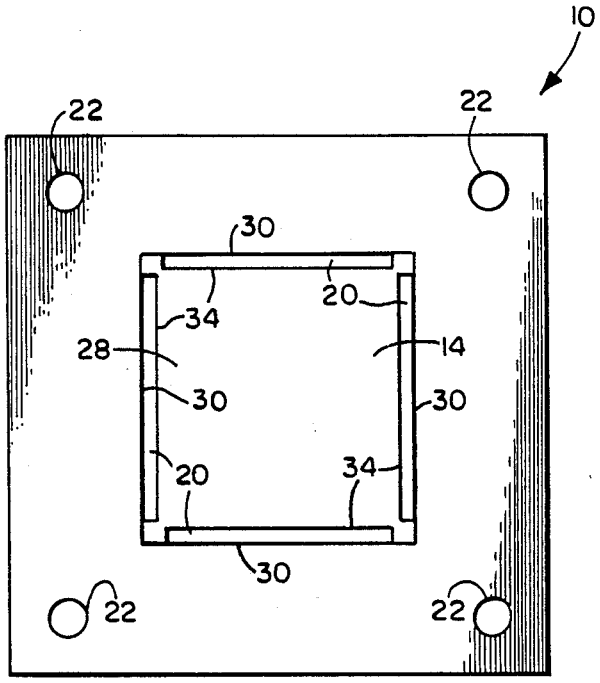
FIG. 1 is a top view of a preferred embodiment of a chip carrier connector constructed in accordance with the present invention.
Figure 2:
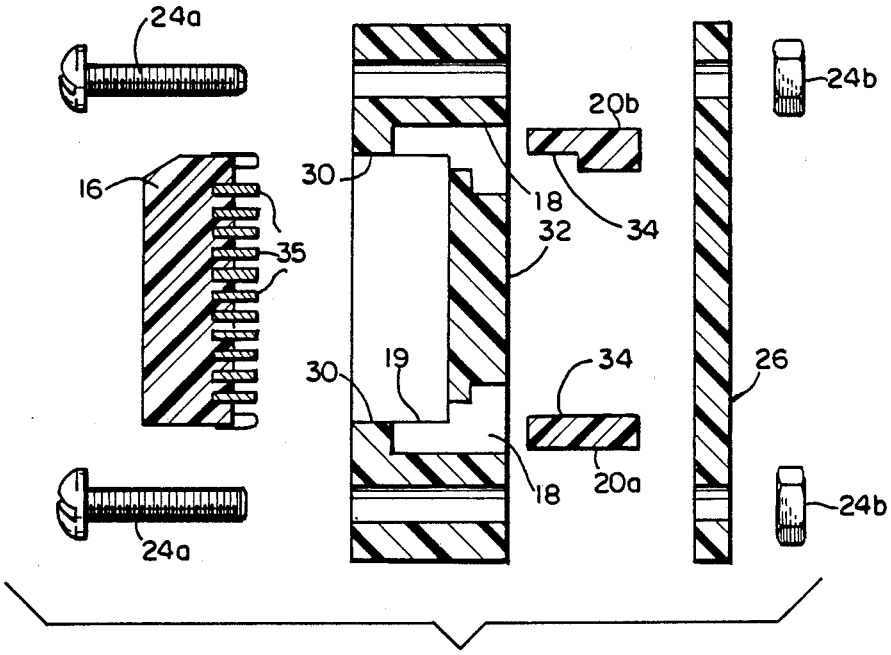
FIG. 2 is an exploded view, partially in section, showing the components of the chip carrier connector as well as a chip carrier and an electronic substrate.
Figure 3:
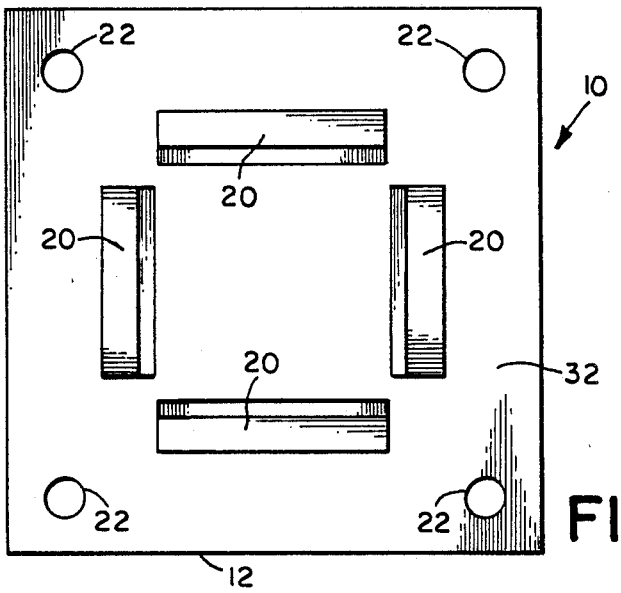
FIG. 3 is a bottom view of the chip carrier connector of FIGS. 1 and 2.

Referring to FIGS. 1, 2, and 3, a connector 10, constructed in accordance with the present invention, includes a housing 12 having a recess 14 adapted to receive a chip carrier 16. Recess 14 is defined by a base surface 28 and a wall structure 30 which is disposed perpendicular to base surface 28. For the embodiment of the invention illustrated in FIGS. 1, 2, and 3, recess 14 is square-shaped and defined by a wall structure having four walls 30.

Housing 12 also as at least one elongated passage 18 extending through the housing from an opening 19 in recess 14 to an external surface 32 of the housing. For the embodiment of the invention illustrated in FIGS. 1, 2, and 3, each of the walls 30 of recess 14 has an opening 19 leading to a passage 18 which extends to the bottom surface 32 of the housing. Bottom surface 32 of the housing is disposed parallel to base surface 28 of recess 14.

Fitted within each passage 18 is a strip 20 of elastomeric elements such as the STAX TM or MOE® (Metal on Elastomer) products described on Technical Data Sheets of Elastomeric Technologies, Inc. , the assignee of this application. Elastomeric strips 20 are fitted in passages 18 to present contact surfaces 34 to the contact leads 35 of chip carrier 16 when the chip carrier is inserted in recess 14. Each contact surface 34 extends along its respective wall 30 of recess 14 and is disposed perpendicular to base surface 28 of the recess, so that when chip carrier 16 is inserted into the recess, its contact leads 35 make lateral contact with the contact surfaces of the elastomeric strips. As illustrated in FIGS. 1 and 3, elongated passages 18 and elastomeric strips 20, fitted within passages 18, extend almost the full length of each of the walls 30. The length of elastomeric strips 20 and the number of such strips are determined by the particular chip carrier with which the chip carrier connector is to be used. Upon insertion, a secure mating or interference fit is achieved between connector 10 and chip carrier 16.

Elastomeric strips 20 are sized to make contact with an electronic substrate, such as a printed circuit board 26. For the embodiment of the invention shown in FIGS. 1, 2, and 3, the elastomeric strips are sized to extend just beyond bottom surface 32 of housing 12. In other applications, they may be sized to extend to a point just short of the end of each passage to accommodate a raised contact surface on the electronic substrate. A connector 10, constructed in accordance with the present invention, also includes means for mounting housing 12 on an electronic substrate, such as printed circuit board 26. Such means may include a plurality of screws 24*a* which are passed through a plurality of holes 22 in housing 12 and aligned holes in the electronic substrate. A corresponding number of nuts 24*b*, when turned onto screws 24*a*, fasten housing 12 in place on substrate 26.

FIG. 2 shows two different cross-sections for elastomeric strips 20. Elastomeric strip 20*a* has a rectangular cross-section which is useful when the electronic substrate has contact surface traces just outside the chip carrier footprint. Elastomeric strip 20*b* has a L-shaped cross-section, in that one end of this elastomeric strip is substantially wider in cross-section than the opposite end. This cross-section is useful when the chip carrier is to be connected to an electronic substrate having contact points which match the footprint of the chip carrier.

Figure 4:
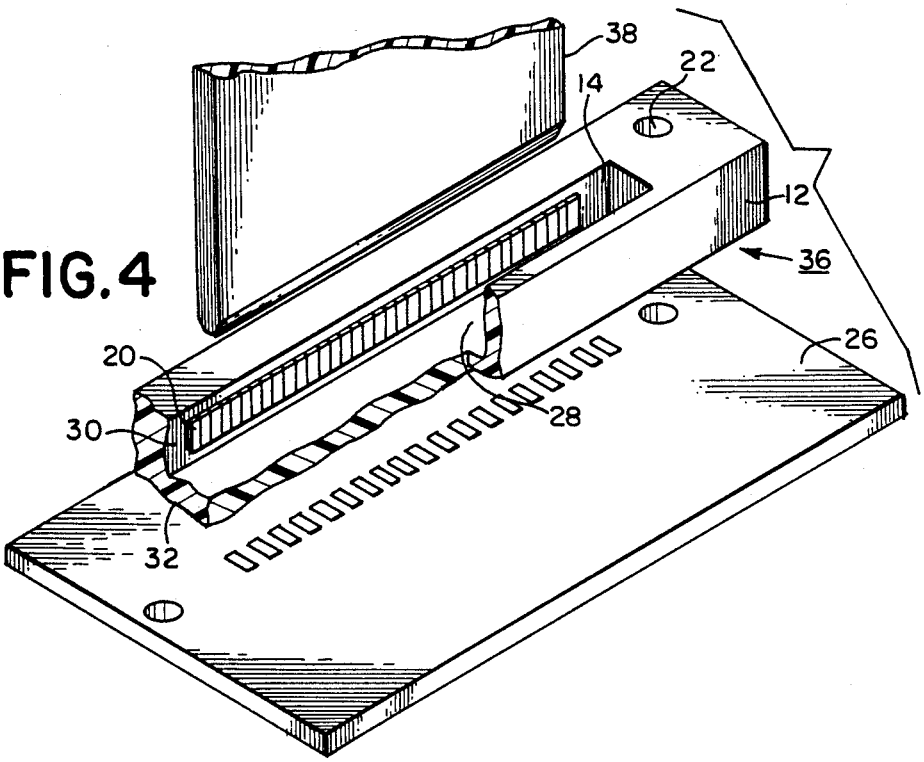
FIG. 4 is an exploded perspective view of a preferred embodiment of an edge card connector constructed in accordance with the present invention.

Referring to FIG. 4 a preferred embodiment of an edge card connector 36, constructed in accordance with the present invention, is illustrated. Edge card connector 36 is designed to receive an edge card 38 in recess 14. Recess 14 is, accordingly, an elongated, rectangular shaped opening.

Elastomeric strip 20 is fitted within an elongated passage on either one or both "long " sides of recess 14, corresponding to the design of the respective edge card. As with chip carrier connector 10 and chip carrier 16, edge card connector 36 and edge card 38 are arranged for a secure mating or interference fit when the edge card is inserted into the edge card connector.

Those skilled in the art will immediately recognize the utility of the present invention in other areas of electrical connectors, such as cable connectors. While preferred embodiments have been described, various modifications and substitutions may be made without departing from the spirit and scope of the invention. Accordingly, it is understood that the present invention has been described by way of illustration and not limitation.

What is claimed is:

1. An electrical component connector comprising:

a housing having;

(a) a recess adapted to receive an electrical component having contact leads, said recess defined by a base surface and a wall structure disposed perpendicular to said base surface, and (b) at least one elongated passage extending through said housing from a first opening at said recess along said wall structure to a second opening at an external bottom surface of said housing, said second opening being wider than the top of said passage a strip of elastomeric elements having a cross section corresponding to the cross-section of said elongated passage;

(a) fitted within said passage in said housing to present to said contact leads of said electrical component when inserted in said recess in said housing a contact surface which extends along said wall structure and is perpendicular to said base surface, and (b) extending through said passage of said external surface of said housing.

2. An electrical component connector comprising:

a housing having;

(a) a square-shaped recess adapted to receive an electrical component having contact leads, said recess defined by a base surface and a wall structure having four walls disposed perpendicular to said base surface, and (b) at least one elongated passage extending through said housing from an opening at said recess along said wall structure to an external surface of said housing; and a strip of elastomeric elements;

(a) fitted within said passage in said housing to present to said contact leads of said electrical component when inserted in said recess in said housing a contact surface which extends along said wall structure and is perpendicular to said base surface, and (b) extending through said passage to said external surface of said housing.

3. A connector according to claim 2 wherein said housing has four elongated passages extending through said housing from openings in said recess along said four walls.

4. An electrical component connector comprising:

a housing having:

(a) a recess defined by a base surface and a wall structure disposed perpendicular to said base surface, said recess adapted to receive a chip carrier having major to band bottom surfaces and having contract leads, and (b) at least one elongated passage extending through said housing from an opening at said recess along said wall structure to an external surface of said housing; and a strip of elastomeric elements;

(a) fitted within said passage in said housing and having a contact surface which extends along said wall structure and is perpendicular to said base surface, said contact surface adapted to contact said contact leads on a side of the chip carrier which is perpendicular to the major top and bottom surfaces of the chip carrier when received in said recess, and (b) extending through said passage to said external surface of said housing.

5. A connector according to claim 4 wherein said recess in said housing is rectangularly-shaped and said wall structure has four walls.

6. A chip carrier connector assembly comprising:

a housing having:

(a) a recess defined by a base surface and a wall structure disposed perpendicular to said base surface, and (b) at least one elongated passage extending through said housing from an opening at said recess along said wall structure to an external surface of said housing;

a strip of elastomeric elements:

(a) fitted within said passage in said housing and having a contact surface which extends along said wall structure and is perpendicular to said base, surface, and (b) extending through said passage to said external surface of said housing; and a chip carrier fitted within said recess in said housing and having contact leads in contact with said contact surface of said strip of elastomeric elements.

7. A chip carrier connector assembly according to claim 6 wherein said housing has a bottom surface disposed parallel to said base surface in said recess in said housing and said elongated passage in said housing and said strip of elastomeric elements extend to said bottom surface of said housing.

8. A chip carrier connector assembly according to claim 7 wherein said strip of elastomeric elements has a rectangular cross-section.

9. A chip carrier connector assembly according to claim 8 wherein:

(a) the end of said elongated passage in said housing at said bottom surface of said housing is wider than the top of said elongated passage in said wall structure, and (b) said strip of elastomeric elements has a cross-section corresponding to the cross-section of said elongated passage.

10. A chip carrier connector assembly comprising:

a housing having:

(a) a recess defined by a base surface and a wall structure disposed perpendicular to said base surface, and (b) at least one elongated passage extending through said housing from an opening at said recess along said wall structure to an external surface of said housing;

a strip of elastomeric elements:

(a) fitted within said passage in said housing and having a contact surface which extends along said wall structure and is perpendicular to said base surface, and (b) extending through said passage to said external surface of said housing;

a chip carrier fitted within said recess in said housing and having contact leads in contact with said contact surface of said strip of elastomeric elements; and an electronic substrate having contact elements, said substrate positioned adjacent to said external surface of said housing with said contact elements in electrical connection with said strip of elastomeric elements.

* * * * *

UNITED STATES PATENT AND TRADEMARK OFFICE

CERTIFICATE OF CORRECTION

PATENT NO. : 4,955,818

DATED : September 11, 1990

INVENTOR(S) : Andrew H. Strange and William P. Sharpe

It is certified that error appears in the above—identified patent and that said Letters Patent is hereby corrected as shown below:

In the Specification:

Column 1, line 48 change "circuit board" to --circuit boards--.

Column 1, line 54 change "long" to --too long--.

Column 3, line 58 change "aligned holes" to --aligned with holes--.

In the Claims:

Column 4, Claim 1, line 29 change ";" to --:--.

Column 4, Claim 1, line 39 change "passage" to --passage;--.

Column 4, Claim 2, line 52 change ";" to --:--.

Column 5, Claim 4, line 12 change "to band" to --top and--.

Signed and Sealed this

Twenty-first Day of April, 1992

*Attest:*

HARRY F. MANBECK, JR.

*Attesting Officer*

*Commissioner of Patents and Trademarks*